US006397402B1

(12) United States Patent
Holland et al.

(10) Patent No.: US 6,397,402 B1
(45) Date of Patent: Jun. 4, 2002

(54) PROTECTIVE UNIFORM FOR COMBINATION FOOTBALL AND SKATING GAME AND OTHER HIGH-IMPACT APPLICATIONS

(75) Inventors: Ronald A. Holland, Newport Beach; Joseph M. Skorpen, Malibu; William L. Fowler, Granada Hills, all of CA (US)

(73) Assignee: Hemisphere Group, Inc., Irvine, CA (US)

( * ) Notice: Subject to any disclaimer, the term of this patent is extended or adjusted under 35 U.S.C. 154(b) by 0 days.

(21) Appl. No.: 09/377,460

(22) Filed: Aug. 19, 1999

(51) Int. Cl.[7] ..... A41D 13/00
(52) U.S. Cl. ..... 2/467; 2/456; 602/19
(58) Field of Search ..... 2/455, 456, 2.11, 2/2.12, 463–467, 410, 16, 22, 24, 44, 69, 92, 910, 911, 913, 918, 2.5, 108; 128/870, 846; 602/5, 19, 20, 16

(56) References Cited

U.S. PATENT DOCUMENTS

| | | | | |
|---|---|---|---|---|
| 1,094,865 A | | 4/1914 | Pierce | |
| 1,269,930 A | | 6/1918 | Hawley | |
| 3,771,171 A | | 11/1973 | Mitchell | |
| 4,453,271 A | | 6/1984 | Donzis | |
| 4,598,427 A | | 7/1986 | Vykukal | |
| 4,599,747 A | | 7/1986 | Robinson | |
| 4,623,158 A | | 11/1986 | Monreal | |
| 4,639,944 A | | 2/1987 | Lashley et al. | |
| 4,783,853 A | | 11/1988 | Zuber | |
| 4,987,613 A | | 1/1991 | Loverdi et al. | |
| 5,044,011 A | | 9/1991 | Henderson | |
| 5,129,108 A | | 7/1992 | Copeland et al. | |
| 5,140,995 A | * | 8/1992 | Uhl | 128/846 |
| 5,331,683 A | | 7/1994 | Stone et al. | |
| 5,337,418 A | | 8/1994 | Kato et al. | |
| 5,353,437 A | | 10/1994 | Field et al. | |
| 5,546,602 A | | 8/1996 | Hale | |
| 5,619,747 A | | 4/1997 | Boisclair et al. | |
| 5,685,831 A | * | 11/1997 | Floyd | 602/19 |
| 5,715,541 A | | 2/1998 | Landau | |
| 5,727,260 A | | 3/1998 | Torch et al. | |
| 5,742,939 A | * | 4/1998 | Williams | 2/69 |
| 5,745,923 A | | 5/1998 | Katz | |
| 5,840,051 A | * | 11/1998 | Towsley | 602/19 |
| 5,868,691 A | * | 2/1999 | Vishnevsky | 602/19 |
| 5,926,857 A | * | 7/1999 | Blodeau | 2/456 |

* cited by examiner

*Primary Examiner*—John J. Calvert
*Assistant Examiner*—Tejash Patel
(74) *Attorney, Agent, or Firm*—Cislo & Thomas, LLP; David L. Hoffman, Esq.

(57) ABSTRACT

A protective uniform for a high-risk or high-impact activity or sport has a rear rigid shell, an artificial spine which may articulate at two sections attached to the shell, and a damper mechanism between the shell and artificial spine. In addition, the artificial spine may be attached to conventional or modified back and hip pads and/or a harness such as worn by rappellers or skydivers. The shell preferably extends from the wearer's head to the tailbone and across the back. The top portion of the shell together with side shields and a face shield form a protective enclosure for the head, inside of which a conventional helmet may be worn. The side shields preferably are movably connected to the rigid shell and are also connected to conventional or modified shoulder pads. The artificial spine is preferably formed in three sections, each section being connected to the other by a limited range universal joint to provide a range of motion comparable to the human neck and the human back. Alternatively, the upper section may be fixed to the middle section and the lower section may have a swivel or universal connection to the middle section.

28 Claims, 5 Drawing Sheets

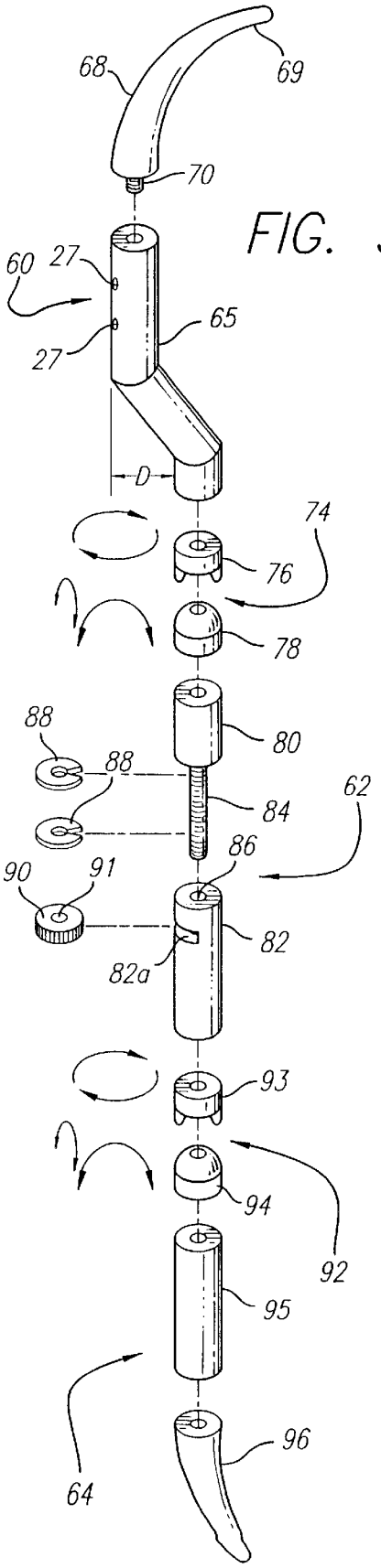
FIG. 3
FIG. 4
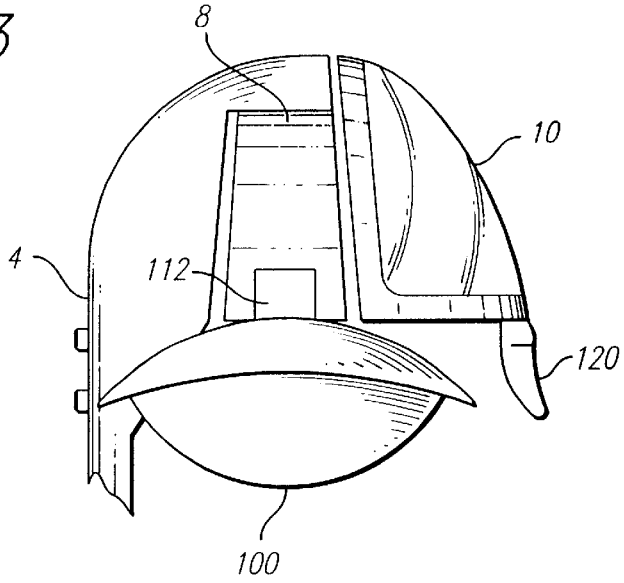
FIG. 7
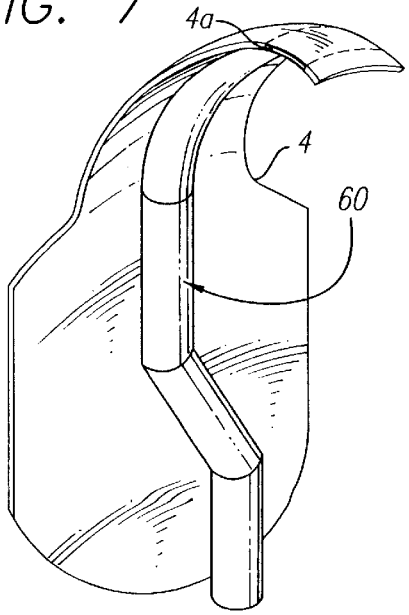

PROTECTIVE UNIFORM FOR COMBINATION FOOTBALL AND SKATING GAME AND OTHER HIGH-IMPACT APPLICATIONS

BACKGROUND OF THE INVENTION

The present invention relates to a protective uniform for a high-impact sport, and more particularly to a protective uniform providing protection for the entire spine, head and much of the body, yet enabling motion of the head, body and arms, and allowing for visibility.

Several protective uniforms exist for impact sports and high-risk activities. One of the most protective is for football, which includes shoulder pads, elbow pads, thigh pads, knee pads, chest, back and tail pads, and a helmet. There are also neck protection collars. Hockey also has protective gear to almost the same extent. Motocross has protective gear that includes thick gloves to protect the hands, a back and chest pad, a helmet and other gear. Generally, these protective uniforms do not connect the back and shoulder pads to the helmet to provide fixed spinal cord protection. The problem with connecting back pads, shoulder pads and a helmet and making them rigid is that this limits head and body turning and limits visibility and athletic motion. Moreover, the pads are generally pliable and thus do not provide rigid protection against bending stress on the spine.

U.S. Pat. No. 5,715,541, issued Feb. 10, 1998 to Landau, discloses a brain and spinal cord protector for higher-risk activities, including motorcycling and other sports. This protector attempts to provide free motion of the head and neck and yet protect against landing on the head, especially with forward motion, which tends to bend the neck and possibly sever the spine. Four rigid posts connect a flexible jacket worn by the user to a bowl-shaped head shield. While this provides some protection for the neck and perhaps upper spine, the spine is not protected from the tailbone to the upper spine. Moreover, this structure still appears to leave the possibility of a buckling of the spine. The connections of the four posts to the helmet will be subject to strong forces and may fail. A second embodiment attempts to minimize this drawback by having a solid rear neck portion, but the uniform still appears to hinder motion substantially.

In view of the above, there is a need for a rigid head, neck and body-protective uniform for the spine yet also allowing athletic motion and visibility.

SUMMARY OF THE INVENTION

In one embodiment, the invention provides a rigid shell for a person's back, neck, and at least a rear portion of the head, preferably to the top or just over the top of the head too. A rigid artificial spine is located between the shell and wearer and is connected to the shell. The connection preferably includes structure to dampen force applied to the shell as it transfers to the spine and major structural parts of the body such as the hips and shoulders through the artificial spine.

An upper portion of the spine preferably universally articulates to a comparable extent as a human neck such that the head has a normal range of motion, and a lower portion of the artificial spine also universally articulates comparable to the lower back. The artificial spine preferably includes an upper curved section to follow the shape of the neck, back of the head and top of the head, a middle section, and a lower section. The sections are connected by universal joints.

The top section preferably attaches to the rigid shell, and the middle section attaches by dampers such as piston dampers to the shell.

In another embodiment, the upper section which follows the curve of the head is rigid and is rigidly connected to a middle section of the spine, and the middle section is connected by a universal joint or swivel joint to a bottom section. The bottom section includes a flexible threaded shaft to which the tail pad or tail bone pad is connected. Two half-rings are fixed to the inside of the shell and mate with two half-rings located at the front of the uniform. A ratchet mechanism is used to custom fit the rear half ring to the wearer.

The player may also wear a conventional football helmet, football or hockey shoulder pads and hip pads, and a motocross back and chest pad. The back and chest pads strap to each other around the sides and also over the shoulder pads. The back pads also have Velcro™ straps to strap around the middle section of the artificial spine. The player may also wear a rappelling-style harness to which the hip pads are mounted. The harness also preferably has a Velcro™ strap to go around a lower portion of the middle section of the artificial spine.

BRIEF DESCRIPTION OF THE DRAWINGS

FIG. 3 is a side partially-schematic, exploded view of an artificial spine in the protective uniform of FIG. 1;

FIG. 4 is a side view of a head section of the protective uniform of FIG. 1;

FIG. 7 is a partial view showing the upper portion of the artificial spine against an inner portion of the shell;

DETAILED DESCRIPTION OF THE PREFERRED EMBODIMENT(S)

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequence may be accomplished by different embodiments that are also intended to be encompassed within the spirit and scope of the invention and the claims thereon.

Figure 1:
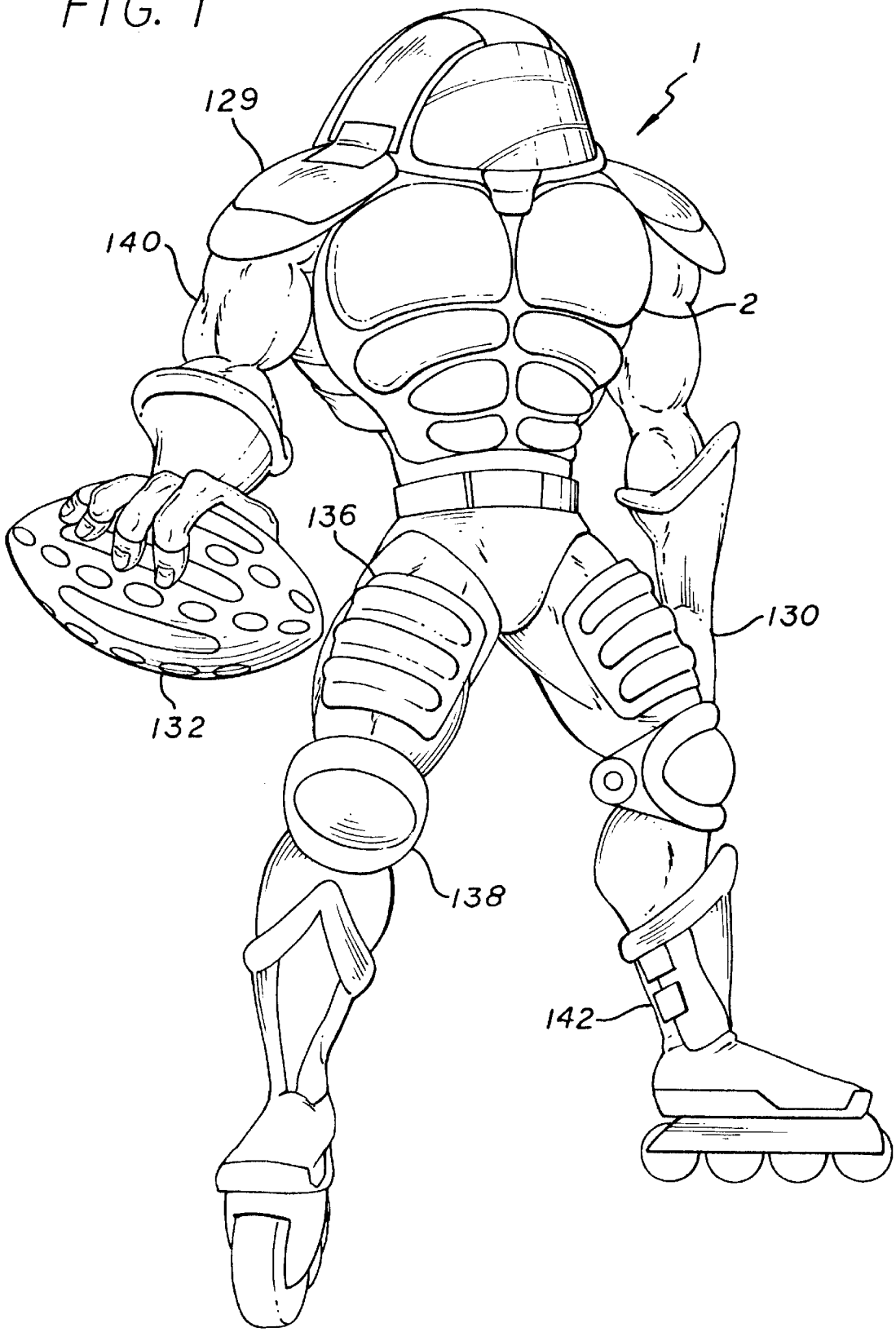
FIG. 1 is a front view of a player in a protective uniform in accordance with the invention.

The exterior of a protective uniform 1 in accordance with the present invention is shown in FIG. 1 on a player. The uniform has an outer shell to protect the upper body and head, interior pads which may be similar to hockey, football, motocross and/or other contact sports, and other pads may be used such as elbow pads, thigh pads, knee pads, shin guards, neck pads or the like.

Figure 2:
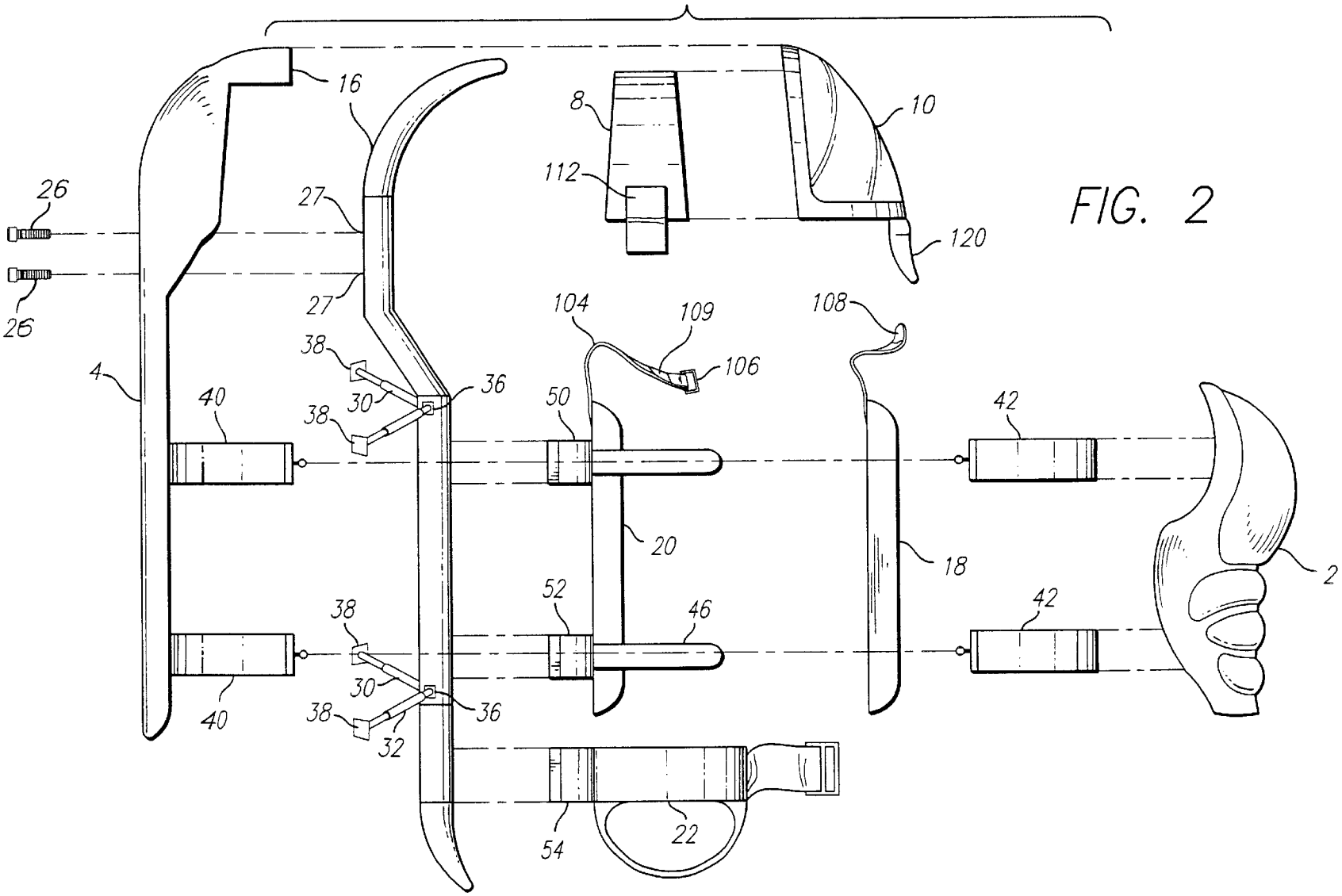
FIG. 2 is a schematic side partially exploded view of the protective uniform of FIG. 1.
Figure 5:
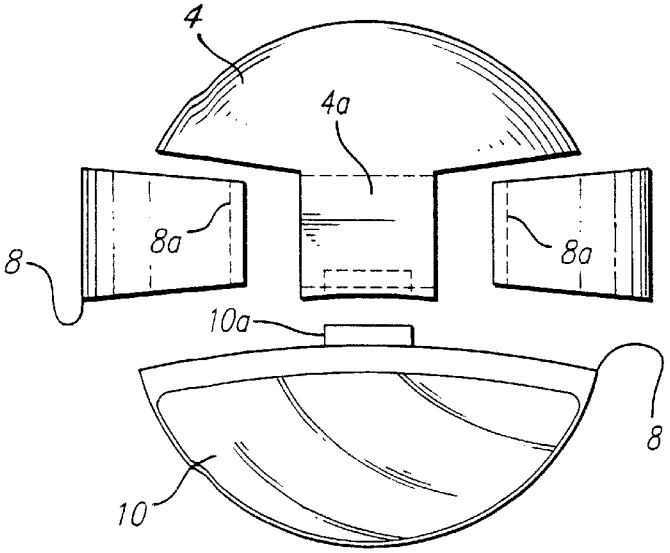
FIG. 5 is a top view of the head section.

With reference to FIGS. 1 and 2, a first embodiment of the invention is shown. An outer shell of the upper portion may include an anatomically shaped front plate 2 and rear shell 4, side shields 8 for the head, and a clear face shield 10. These elements are supported in part by an artificial spine 16. The interior pads may include shoulder pads (not shown in FIG. 2), a chest pad 18 and a back pad 20, harness 22 and hip pads (also not shown in FIG. 2) and, if desired, a tail pad. The shoulder pads, hip pads and tail pad may be conventional football- or hockey-style pads. The chest pad and back pad may be conventional motocross-style pads. The harness may be a conventional rappelling or skydiving harness.

The various parts may be attached as follows:

The rear shell 4 is screwed or otherwise fixed to the top portion of spine 16 by screws 26 into threaded holes 27. Shell 4 also contacts spine 16 through a dampening mechanism to absorb impact, e.g., by use of piston dampers 30 each having a cylinder 32 and a piston 34, and each being attached to spine 16 and shell 4 by, e.g., a slidable contact fit to enable twisting and other movements of the spine, as explained below. The middle portion of the spine has the other ends 36 of the dampers fixed to it, e.g., by welding, adhering, screws or otherwise. The dampers could also be springs, a dampening material such as rubber, or the like. The positioning of the pistons and cylinders could also be reversed.

Shell 4 is also connected to the front plate or pad 2, e.g., by two pairs of half-rings 40, 42 unitary with or fixed to shell 4 and front pad 2, respectively. These half-rings connect together, e.g., by a ball and socket or other snap fit or other readily connectable and disconnectable joint. The ribs serve to hold the shell 4, e.g., by means of a Velcro™ fastener attachment, and the chest pad 2 by a similar attachment. The shell also attaches by Velcro™ to the top of the shoulder pads.

Two pairs of straps 44, 46 made to hold back pad 20 to a front chest pad 18, e.g., by Velcro™ fasteners attached to front pad 18. Rear fasteners 50, 52, e.g., Velcro™ straps and a Velcro™ pad hold spine 4 to the back pad and by virtue of their positioning above the lower set of dampers and below the upper set of dampers will serve to limit vertical movement of spine 16. Harness 22 may have hip pads mounted on it or may hold the pads inside it which, e.g., may be hard-case hockey pads. It also has a rear fastener 54 like the fasteners 50, 52 to hold spine 16 at a lower portion thereof. These connections between the pads and spine serve to transfer impact on the shell to large or strong portions of the body such as the hips and overall torso, and to the shoulders due to straps around the shoulder pads explained below.

Ties, buckles or other means may be used in place of Velcro™ fasteners.

FIG. 3 shows a detail of spine 16 which is preferably formed in three main portions, upper portion 60, middle portion 62 and lower portion 64. These connect by joints such as a limited-range universal joints to allow three-dimensional motion of the player with the artificial spine in spite of the hard, rigid shell 4.

The upper portion 62 has a rear bent base 65 which generally follows the shape of the neck to the back of the head, threaded holes 27 for the screws from the shell, a lower end designed to be at the level of a player's sixth cervical vertebra, with an indentation distance D of approximately six inches. A crown piece 68 of the upper portion has a threaded screw 70 which enters a threaded hole 72 in base piece 65. The crown piece 68 has a concave curve to follow the middle and top of the head and support the shell. It has a free end 69.

A first or upper universal joint 74 includes an upper joint piece 76 and a lower joint piece 78 with a universal mounting. The universal joint preferably enables 360-degree turning about the axis of the spine, bending forward and back of about 180 degrees, and bending right and left of about 180 degrees to approximate or accommodate the normal bending ranges of the neck.

An upper joint piece 76 is fixed to the bottom of base 65 and a lower joint piece 78 is fixed to the top of middle spine portion 62. Fixing may be accomplished by a threaded rod with a threaded hole, welding, or other suitable attachment.

Middle spine portion 62 includes an upper member 80 and a lower member 82, each providing a point of attachment for the back pad and for the upper and lower sets of dampers, respectively, as shown in FIG. 2.

Optionally, spacers 88, e.g., one half inch thick, may be placed between the upper and lower members 80, 82 and friction fit, threaded or otherwise fixed in place. A knurled adjustment ring 90 with a threaded center hole 91 is provided in a slot 82*a* in the lower member 82 of the middle spine portion 62. Threaded rod 84 enters hole 86 and threads into knurled ring 90 at a threaded center hole 91. Thus, turning ring 90 can adjust the spine length and enable insertion or removal of spacers.

A second universal joint 92 has an upper joint piece 93 attached to lower member 82 of the middle section and a lower joint piece 94 attached at the top of lower spine portion 64 in the same manner as the first universal joint 74. The range of motion may be similar to the first universal joint as well. This second universal joint is preferably located at approximately a player's twelfth thoracic vertebra.

Lower spine portion 64 includes a cylindrical member 95 and a tailbone guard 96 fixed thereto, e.g., by threaded screw and threaded hole attachment as base 65 and crown piece 68 are attached. The spine preferably is made of a rigid and strong material, e.g., a light-weight steel alloy such as chromalloy steel, and ends formed by the crown piece 68 and tailbone guard 96 may be of a strong plastic such as polycarbonate.

With reference to FIGS. 2 and 4, the wearer preferably has shoulder pads 100 such as conventional football or hockey shoulder pads. Each shoulder pad is strapped down by a shoulder strap 104 with a buckle 106 and a strap 108 attached to the chest and back pads 18, 20, respectively. A Velcro™ receiving pad 109 is stitched to strap 104. Each side shield 8 has a strap 112 affixed to it (e.g., by epoxy, rivet, or other means) and has a Velcro™ pad stitched to the strap. The Velcro™ attaches the strap 112 to the shoulder strap 104 at pad 109. Thus, due to the strap 112, the shoulders have some flexibility so the wearer may raise or rotate his or her arms.

Figure 6:
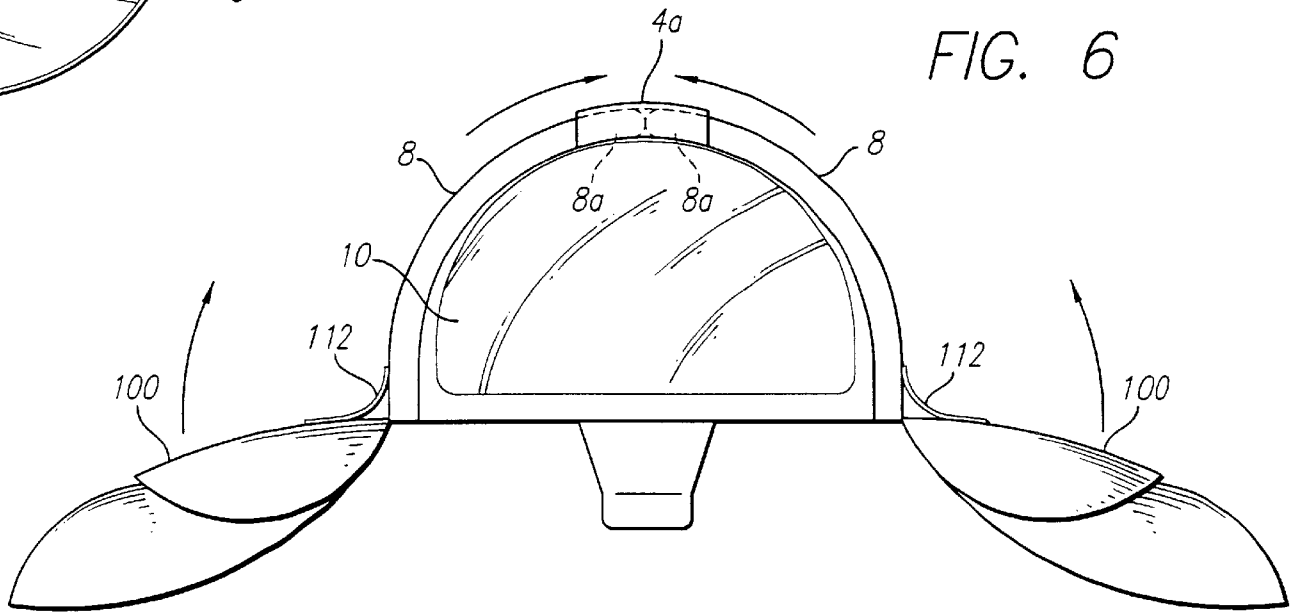
FIG. 6 is a front, partially schematic view of the head portion of the protective uniform illustrating connection of the upper portion to shoulder pads and motion of side shields of the upper portion.

In addition to the flexibility provided by the strap 112, side shields 8 at their tops 8*a* fit like a tongue and groove in a slot 4*a* formed in the shell 4 (FIG. 6). The tongue portion of shield 8, e.g., tongue 8*a*, may have an enlarged end which serves to limit removal from the slot 4*a*. Alternatively, the side shields may be hinged to the top 4*a* of the shell The face shield 10 attaches to the top of the shell by a tongue in groove connection of a tongue 10*a* into the top 4*a* of the shell. Face shield 10 has a hanging throat guard 120.

With reference to FIG. 1, the shoulder pads may have a top portion 129 to match the molded front chest portion 2. In addition, the player may wear protective gloves 130 with wrist shields. The gloves may have open fingertips to assist in gripping a ball 132. The uniform may be particularly useful for a new sport combining football and in-line skating as disclosed in a U.S. Patent Application entitled COMBINATION FOOTBALL AND SKATING GAME WITH ENCLOSED RAMP FIELD AND DIFFERENT SCORING ZONES, filed on Apr. 30, 1999, and assigned Ser. No. 09/302,585, which is hereby incorporated by reference.

The player may also be wearing thigh pads 136, knee pads 138, and arm pads 140. Further, the player may be wearing in-line skates 142 in accordance with the above-mentioned game. The game may be played in a modified in-line skate designed to obtain a push start for quick acceleration and blocking, e.g., while leaning forward. Such a skate is disclosed in a U.S. Patent Application entitled SAFETY BRAKE FOR IN-LINE SKATES, filed on Apr. 30, 1999 and assigned Ser. No. 09/302,542, which is hereby incorporated by reference.

The player may also wear neck pads such as in football.

Figure 9:
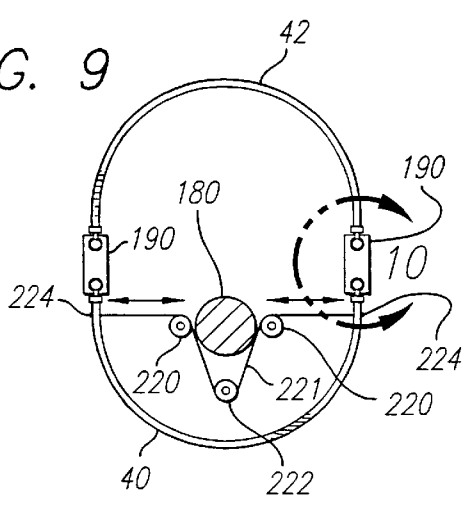
FIG. 9 is a sectional view taken along the line 9—9 of FIG. 8 showing a custom fit ratchet mechanism for fitting ribs of the uniform in accordance with the second embodiment.
Figure 10:
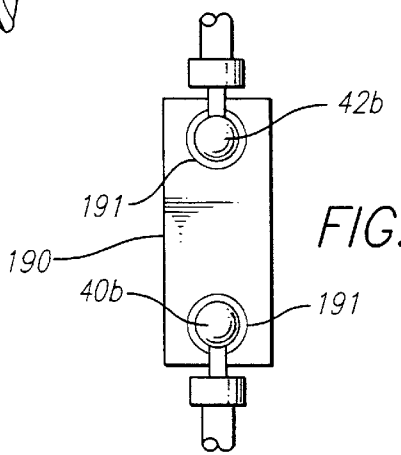
FIG. 10 is a partial view of a pair of ribs having balls being fitted into a socket.
Figure 8:
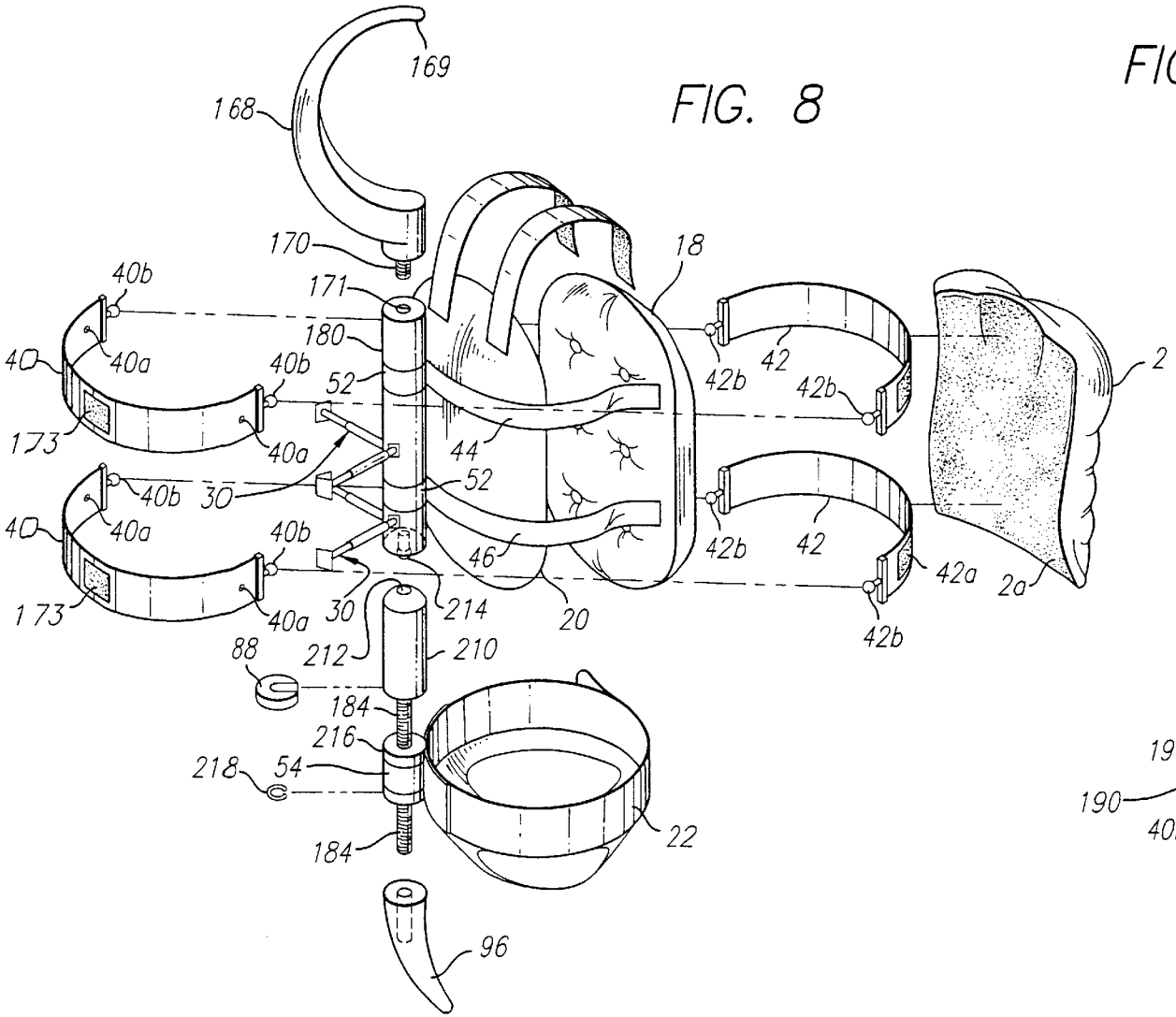
FIG. 8 is a schematic partially exploded side perspective view of the spine, pads and dampers according to a second embodiment of the invention.

A second embodiment of the invention is shown in FIGS. 8 and 9. In this embodiment, like elements are given like reference numerals. The spine has a top portion 168 which is rigid and has a free upper end 169 that simply is disposed within the shell. The shell, as in the prior embodiment, may be affixed to the upper portion of the spine 168 by screws. It may also attach by other means such as Velcro™ straps. The face shield and side shields may be constructed as in the previous embodiment. The ribs attach by Velcro™ pads 173 to the shell. Rather than fix the upper portion of the shell to the upper portion of the spine, the shell may simply rest against the upper portion of the spine. The spine has a rigid middle portion 180 which has a threaded hole 171 at its top for receiving a screw 170 integrally attached to the upper portion 168. As in the previous embodiment, the middle portion of the spine has a dampening mechanism 30 attached to it. Plates at the ends of the pistons of the dampener attach or rest against the inner periphery of the back ribs 40. The middle portion 180 of the spine has a lower end with a swivel connector 214 which fits into a socket 212 at the top end of the lower portion 210 of the spine. Preferably, the lower portion of the spine has a convex top end to fit with a concave lower end of the middle portion of the spine. The lower portion 210 has a flexible threaded shaft 184 on which a spacer 88 may be mounted, the attachment member 216 for harness 22, a retaining ring 218 to hold the attachment member in place, and a sacral pad 96 formed preferably of a solid plastic. This may be the same as the tail bone guard 96 of the previous embodiment. The joints in this embodiment, including the rigid joint between the upper and middle portions of the spine and the universal or swivel joint between the middle and lower portions of the spine, may be located at the same place as the universal joints of the previous embodiment. The pads may all connect with similar straps as in the previous embodiment. The front ribs 42 preferably have a Velcro™ surface 42*a* on their exterior faces to attach to a Velcro™ surface 2*a* on the inside of the chest member 2. In addition, the ribs 40 and 42 may have balls 40*b* and 42*b* which fit within padded insert elements 190 in a socket 191 therein. In addition, a ratchet device or custom fit device which includes two pulleys 220, a kevlar cord 221, e.g., having a 5 mm diameter, and a ratcheting pulley 222 may cinch in or let out the sides of the rear ribs. The kevlar cord has ends 224 which pass through holes 40*a* in the rear ribs and which may be enlarged. The enlarged ends may be pulled selectively to tighten or loosen the ratchet system. There is a ratchet system for each back rib 40.

The harness 22 and back pad 20 may be attached to the spine by rear fasteners identical to fasteners 50, 52 and 54, as in the previous embodiment.

While the present invention has been described with regards to particular embodiments, it is recognized that additional variations of the present invention may be devised without departing from the inventive concept.

What is claimed is:

1. A protective uniform for protecting a human wearer participating in a high-impact and high-risk activity, the uniform comprising:

a rigid shell sized and adapted to substantially extend across a human's back and from at least about the human's coccyx to at least about the human's head by protecting the back from impact;

an artificial spine extending substantially the same length as the rigid shell, the artificial spine having first means for mounting the rigid shell thereto; and second means for mounting the artificial spine to the human.

2. The protective uniform of claim 1, wherein the rigid shell is formed unitarily.

3. The protective uniform of claim 1, wherein the artificial spine comprises means for enabling a portion of the spine to articulate with respect to another portion of the spine.

4. The protective uniform of claim 1, wherein the artificial spine comprises three sections and there is at least one universal joint connecting a first one of the sections to a second of the sections for enabling twisting motion, lateral bending motion and forward and back bending motion of the first section of the spine with respect to the second section.

5. The protective uniform of claim 4, wherein the universal joint is located approximately at a distance from the other joint corresponding to a distance from the sixth cervical spine to the twelfth thoracic lumbar spine of a human.

6. The protective uniform of claim 4, wherein the first means comprises means for fixedly attaching the rigid shell to the artificial spine at an upper one of the three sections of the spine, and the means for dampening transference of force from the shell to the spine is fixed to a middle one of the three sections of the spine.

7. The protective uniform of claim 1, further comprising means for dampening transference of force from the shell to the spine.

8. The protective uniform of claim 1, further comprising a back pad and the second means for mounting includes means mounted to the back pad.

9. The protective uniform of claim 8, further comprising a chest pad, shoulder pads, and straps for holding the shoulder pads and also connecting the back pad to the chest pad.

10. The protective uniform of claim 8, further comprising a harness for mounting on a human's thighs and hips and the second means for mounting includes means mounted to the harness.

11. The protective uniform of claim 1, further comprising a harness for mounting on a human's thighs and hips and the second means for mounting includes means mounted to the harness.

12. The protective uniform of claim 1, wherein the first means for mounting comprises means for fixedly attaching the rigid shell to the artificial spine.

13. The protective uniform of claim 1, further comprising a back pad and the second means for mounting includes means mounted to the back pad.

14. The protective uniform of claim 13, further comprising a chest pad, shoulder pads, and straps for holding the shoulder pads and also connecting the back pad to the chest pad.

15. The protective uniform of claim 14, further comprising a harness for mounting on a human's thighs and hips and the second means for mounting further includes means mounted to the harness.

16. The protective uniform of claim 1, wherein the means for dampening transference of force from the shell to the spine is fixed to the spine and contacts the shell.

17. The protective uniform of claim 1 further comprising a face shield and side shields, and means for connecting the side shields to a top portion of the shell for relative motion thereto.

18. The protective uniform of claim 1 further comprising rear ribs connected to the shell and front ribs connected to the rear ribs, and means for tightening the rear ribs.

19. A protective uniform for protecting a human wearer participating in a high-impact and high-risk activity, the uniform comprising:

a rigid shell sized and adapted to substantially extend across a human's back and from at least about the human's coccyx to at least about the human's head by protecting the back from impact;

an artificial spine extending substantially the same length as the rigid shell, the artificial spine having first means for mounting the rigid shell thereto, wherein the artificial spine comprises three sections and two joints connecting the sections, at least one of the joints being a universal joint for enabling twisting motion, lateral bending motion and forward and back bending motion of one section of the spine with respect to another section, and the first means comprises means for fixedly attaching the rigid shell to one of the three sections of the artificial spine;

second means for mounting the artificial spine to a human; and means for dampening transference of force from the shell to the spine.

20. The protective uniform of claim 19, wherein the rigid shell is formed unitarily.

21. The protective uniform of claim 19, wherein the means for dampening transference of force from the shell to the spine is fixed to the spine and contacts the shell.

22. The protective uniform of claim 19, wherein the two joints are both universal joints and are located approximately a distance apart corresponding to a distance from the sixth cervical spine to the twelfth thoracic lumbar spine of a human.

23. The protective uniform of claim 19, wherein the means for fixedly attaching attaches the rigid shell to the artificial spine at an upper one of the three sections of the spine, and the means for dampening transference of force from the shell to the spine is fixed to a middle one of the three sections of the spine.

24. The protective uniform of claim 19 further comprising a face shield and side shields, and means for connecting the side shields to a top portion of the shell for relative motion thereto.

25. The protective uniform of claim 19 further comprising rear ribs connected to the hell and front ribs connected to the rear ribs, and means for tightening the rear ribs.

26. A protective uniform for protecting a human wearer participating in a high-impact and high-risk activity, the uniform comprising:

a rigid shell for substantially extending across a human's back and from at least about the human's coccyx to at least about the human's head for protecting the back from impact;

an artificial spine extending substantially the same length as the rigid shell, the artificial spine having first means for mounting the rigid shell thereto; and second means for mounting the artificial spine to a human, wherein the artificial spine comprises a rigid upper section, a rigid middle section extending a length substantially equal to that of a human's twelfth thoracic vertebra to a human's sixth cervical vertebra, and a rigid lower section, there is a substantially rigid head protection unit for wearing on the wearer's head, means for connecting the head protecting unit to the upper section of the spine, wherein the shell is mounted to the middle section of the spine, the spine comprises a first universal joint for connecting the upper and middle sections for rotation with respect to each other and for bending with respect to each other, a second universal joint for connecting the lower section of the spine to the middle section for rotation with respect to each other and for bending with respect to each other, and means for connecting the lower section of the spine to the wearer's body.

27. A protective uniform for protecting a human wearer participating in a high-impact and high-risk activity, the uniform comprising:

a rigid shell for substantially extending across a human's back and from at least about the human's coccyx to at least about the human's head for protecting the back from impact;

an artificial spine extending substantially the same length as the rigid shell, the artificial spine having first means for mounting the rigid shell thereto; and second means for mounting the artificial spine to a human, wherein the uniform further comprises a back pad, and the second means for mounting includes means mounted to the back pad.

28. A protective uniform for protecting a human wearer participating in a high-impact and high-risk activity, the uniform comprising:

a rigid shell for substantially extending across a human's back and from at least about the human's coccyx to at least about the human's head for protecting the back from impact;

an artificial spine extending substantially the same length as the rigid shell, the artificial spine having first means for mounting the rigid shell thereto; and second means for mounting the artificial spine to a human, wherein the uniform further comprises a harness for mounting on a human's thighs and hips and the second means for mounting includes means mounted to the harness.

* * * * *